US009861851B1

(12) United States Patent
Owens

(10) Patent No.: US 9,861,851 B1
(45) Date of Patent: Jan. 9, 2018

(54) HAND SPEED TRAINER

(71) Applicant: Phillip David Owens, Jenks, OK (US)

(72) Inventor: Phillip David Owens, Jenks, OK (US)

( * ) Notice: Subject to any disclaimer, the term of this patent is extended or adjusted under 35 U.S.C. 154(b) by 551 days.

(21) Appl. No.: 13/959,319

(22) Filed: Aug. 5, 2013

Related U.S. Application Data

(63) Continuation of application No. 12/221,095, filed on Jul. 31, 2008, now abandoned, which is a continuation of application No. 10/020,598, filed on Dec. 14, 2001, now abandoned.

(51) Int. Cl.
*A63B 21/065* (2006.01)

(52) U.S. Cl.
CPC ..... *A63B 21/065* (2013.01)

(58) Field of Classification Search
USPC .... 482/44, 50, 74, 79, 92–94, 105; 473/207, 473/212–214, 227, 256, 437, 450, 458; 602/20–21, 62–63, 901; 2/22, 170; D21/683
See application file for complete search history.

(56) References Cited

U.S. PATENT DOCUMENTS

| | | | | |
|---|---|---|---|---|
| 1,729,209 | A | 9/1929 | Curtice | |
| 2,241,833 | A * | 5/1941 | Waller | 482/105 |
| 3,490,766 | A | 1/1970 | Gardner | |
| 3,580,572 | A | 5/1971 | Strafford | |
| 3,759,510 | A | 9/1973 | Jackson, Jr. | |
| 3,924,851 | A | 12/1975 | Winston | |
| 4,195,833 | A | 4/1980 | Svendsen | |
| 4,303,239 | A | 12/1981 | Walsh, Jr. | |
| 4,330,120 | A * | 5/1982 | Netti | 482/105 |
| 4,476,857 | A * | 10/1984 | Levine | 602/20 |
| D290,766 | S | 7/1987 | Pierce, Jr. | |
| 4,756,026 | A | 7/1988 | Pierce, Jr. | |
| 4,966,365 | A | 10/1990 | Winston | |
| 5,010,596 | A | 4/1991 | Brown et al. | |
| D339,838 | S | 9/1993 | Winston | |
| 5,261,871 | A * | 11/1993 | Greenfield | 602/26 |
| 5,300,000 | A | 4/1994 | Schwartz | |

(Continued)

OTHER PUBLICATIONS

Eastbay—The Athletic Sportsource, "BWA The Glove W/2" Strap," Baseball 2001 Catalog, Eastbay—The Athletic SportSource (Wassau, WI, United States), (p. 54).

*Primary Examiner* — Loan H Thanh
*Assistant Examiner* — Jennifer M Deichl
(74) *Attorney, Agent, or Firm* — Frank J. Catalano; Gable Gotwals

(57) ABSTRACT

A hand speed training device comprised of a tight fitting sleeve which is worn on the forearm of the user. The sleeve is made of a neoprene material or other elastic material. The device has one or more elongated pockets on the outside of the sleeve. Each pocket has a slot in it. Also each pocket is attached along its periphery to the hand speed trainer. In an alternate embodiment the pockets are each attached along their periphery to the hand speed trainer however one end is left open. The pockets are oriented so they are parllel with the longitudinal axis of the device. A weight made of lead or other dense material is inserted in the pockets. The device is worn by the user during exercises. It is particularly helpful in developing upper body strength and coordination for sports such as baseball, tennis, or golf where such strength is advantageous.

2 Claims, 3 Drawing Sheets

(56) References Cited

U.S. PATENT DOCUMENTS

| | | | | |
|---|---|---|---|---|
| 5,458,617 | A | | 10/1995 | Bystrom |
| 5,468,200 | A | | 11/1995 | Hoffman |
| 5,514,056 | A | | 5/1996 | Ronca et al. |
| 5,607,378 | A | | 3/1997 | Winston |
| 5,657,996 | A | | 8/1997 | Radgowski et al. |
| 5,667,466 | A | | 9/1997 | Riley, Jr. |
| 5,704,883 | A | | 1/1998 | Eckmann |
| 5,925,010 | A | * | 7/1999 | Caprio, Jr. ..... 602/62 |
| 5,983,391 | A | | 11/1999 | Palmer et al. |
| D431,693 | S | | 10/2000 | Urquhart et al. |
| 6,213,920 | B1 | * | 4/2001 | Ronca et al. ..... 482/105 |
| 6,244,997 | B1 | | 6/2001 | Cook |
| 6,472,590 | B1 | | 10/2002 | Kulik |

* cited by examiner

HAND SPEED TRAINER

CROSS-REFERENCE TO PRIOR APPLICATIONS

This is a continuation patent application which claims priority to U.S. patent application Ser. No. 12/221,095 filed Jul. 31, 2008 (now abandoned), which claimed priority to U.S. patent application Ser. No. 10/020,598 filed Dec. 14, 2001, (now abandoned).

REFERENCE TO MICROFICHE APPENDIX

This application is not referenced in any microfiche appendix.

TECHNICAL FIELD OF THE INVENTION

The present invention generally relates to weights worn on the extremities during exercise to increase strength, speed, and agility. More specifically, a sleeve containing weights which can be worn on the forearm of an athlete to increase the speed, strength, and agility useful in sports such as baseball, softball, tennis, racquetball, golf, and the like.

BACKGROUND OF THE INVENTION

Weights worn on the arms and legs of athletes are well known. U.S. Pat. No. 4,330,120 issued to James Netti on May 18, 1982 for a Running or Jogging Exercising Glove (the '120 patent). The '120 patent discloses an exercise device for conditioning the upper arms and body muscles. The device includes a glove having a hand section, a wrist section and a forearm section, the glove encompassing the entire forearm region of the wearer. The hand section and the forearm section of the glove contains strategically positioned weights that are arranged to enhance development and toning of the arm and upper body muscles when the arm is moved through a normal swinging motion, as for example, when the wearer is running or jogging.

U.S. Pat. No. 4,966,365 issued to Edith Winston on Oct. 30, 1990 for a Body Exercise Device (the '365 patent). The '365 patent discloses a weight with a fabric body of a rectangular shape for encircling a user's limb. The fabric body includes a plurality of side-by-side compartments each receiving a packet of particulate, and a foam panel occupying an interposed position between the body and the user's limb. The particulate conforms to the shape of the user's limb, and in conjunction with the foam panel contributes to comfort during the wearing of the body.

Likewise U.S. Pat. No. 5,667,466 issued to John L. Riley, Jr. on Sep. 16, 1997 for a Wrist or Ankle Exercise Weight (the '466 patent). The '466 patent discloses an adjustable weighted exercise sleeve that fits over the hand or foot and is secured thereto enabling the user to accomplish various exercises with the benefit of weight resistance. The adjustable weighted exercise sleeve has adjustable straps secured by hook and loop fasteners to provide a comfortable fit for the user. The configuration of the exercise sleeve and adjustable straps allows the user to interchangeably wear the exercise sleeve on the hand and wrist or foot and ankle. The exercise sleeve uses variable weighting arrangements to allow the user to choose a weight resistance for optimum comfort and physiological benefit.

Further U.S. Pat. No. 5,704,883 issued to James A. Eckmann on Jan. 6, 1998 for a Hand and Wrist Weight Assembly (the '883 patent). The '883 patent discloses a hand and wrist weight assembly has a web with a finger-receiving part, a back section on which a hand weight is mounted along the back of the user's hand, and a wrist section on which a wrist weight, independent of the hand weight and spaced from the hand weight is mounted along the back of the user's wrist. The wrist section has a strap for retaining the assembly on the user's arm. The back section and wrist section are flexible both transversely and longitudinally to permit flexing of the user's wrist while the assembly is in place, and conformance to a part of the user's hand and wrist over which the back section and the wrist section extend. The hand weight and the wrist weight are both soft and complaint to the extend that they will conform to the contours of the back of the hand and the wrist. The wrist weight can take the form of one or more elongated, transversely extending, particle-filled pouches, secured to the wrist section of the web.

One of the drawbacks of the prior art is that they all rely upon some form of strap to hold the weights in place on the user's extremities. The use of straps leads to a localization of pressure on the user's extremities in the area underneath the straps. At best this localized pressure causes an unnatural feeling which can alter the movement of the user. At worst it can create discomfort and extremely alter the movement of the user.

A second drawback of the prior art seen in the '120, the '466 and the '883 patents is that the device is worn on the hands. This in turn interferes with the user's grip and makes it difficult for the user to grasp sports equipment such as baseball bats, rackets, golf clubs and the like.

BRIEF SUMMARY OF THE INVENTION

In response to the shortcomings of the prior art, the applicant has developed an innovative and improved weight device which can be worn on the extremities. This device does not rely upon straps to maintain its place. Instead it is constructed of a stretchy material such as nylon laminated CR neoprene rubber which provides a snug fit between the user's extremities and the hand speed trainer. This snug fit provides an even distribution of pressure across the entire extremity. This uniform pressure across the extremity provides a more natural feel which does not inhibit or alter the movement of the user thus leading to a more natural movement while the hand speed trainer is in use.

Another advantage of the present invention is that when it is worn on the forearms it does not cover the hands and wrist. This leaves the user free to use his hands and wrists as he normally would during the use of the hand speed trainer.

The present invention also provides a unique weight system which allows the user to change the weight of the sleeve by adding or removing weights into a pocket.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

In this respect, before explaining at least one embodiment of the invention in detail, it is to be understood that the invention is not limited in this application to the details of construction and to the arrangement so the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further, the purpose of the foregoing abstract is to enable the U.S. Patent and Trademark Office and the public generally, and especially the design engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Additional objects and advantages of the invention are set forth, in part, in the description which follows and, in part, will be apparent to one of ordinary skill in the art from the description and/or from the practice of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference would be had to the accompanying drawings, depictions and descriptive matter in which there is illustrated preferred embodiments and results of the invention.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative ofspecific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 1:
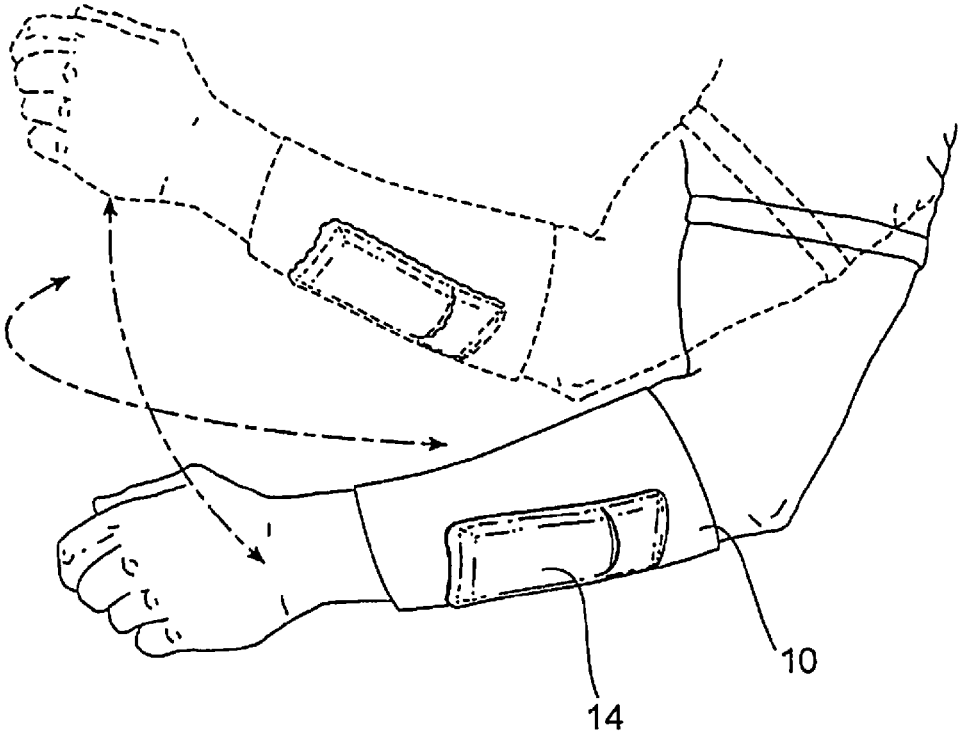
FIG. 1 is a drawing of the present invention in use.

FIG. 1 is a perspective view of the hand speed trainer 10 being worn on the forearm of a user. As can be seen in FIG. 1, the hand speed trainer 10 fits snugly on the forearm of the user leaving the user's hands and wrists unencumbered thus allowing a natural movement in the hands and wrist and allowing the user to grasp sporting equipment such as bats, racquets, and clubs. This in turn allows the user to use the hand speed trainer 10 while participating in such sports as baseball, golf, tennis, racquetball, and the like; thus allowing the user to build up hand speed, arm strength, and coordination.

Figure 2:
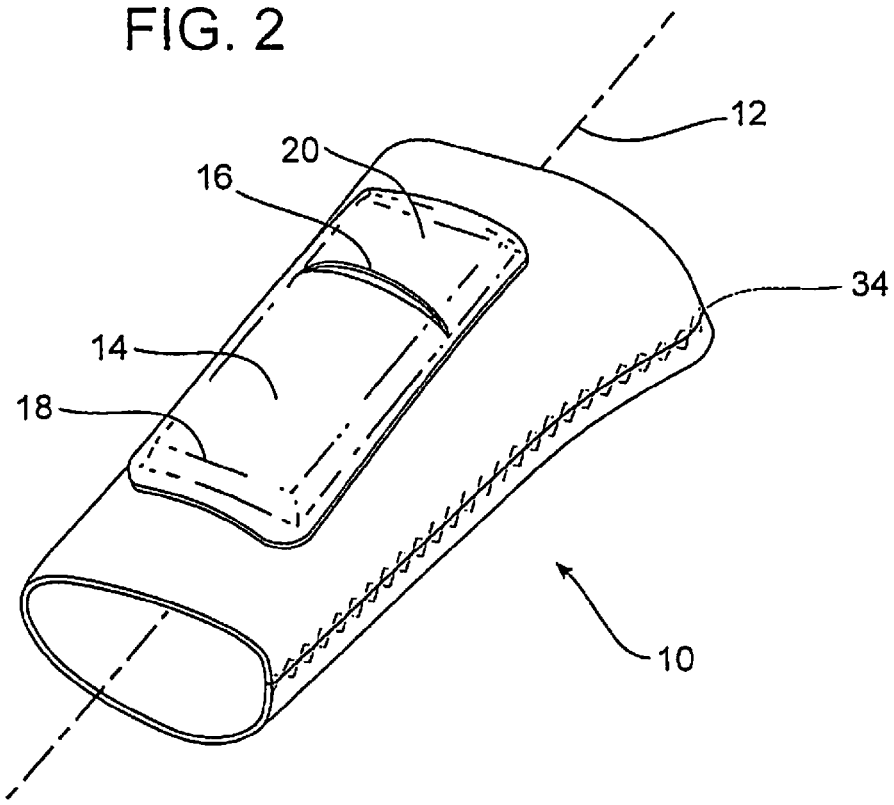
FIG. 2 is a perspective view of the present invention.

FIG. 2 is a perspective view of the hand speed trainer 10. As can be seen in FIG. 2 the hand speed trainer 10 has a longitudinal axis 12. In the preferred embodiment an elongated pocket 14 with a slot 16 and a first and second end, 18 and 20 is located on the outside of the hand speed trainer 10 such that the pocket 14 is parallel with the elongated axis 12. The slot 16 is located towards either the first or second end 18 or 20 of the pocket. The pocket 14 is sewn along its periphery to the hand speed trainer 10.

Figure 3:
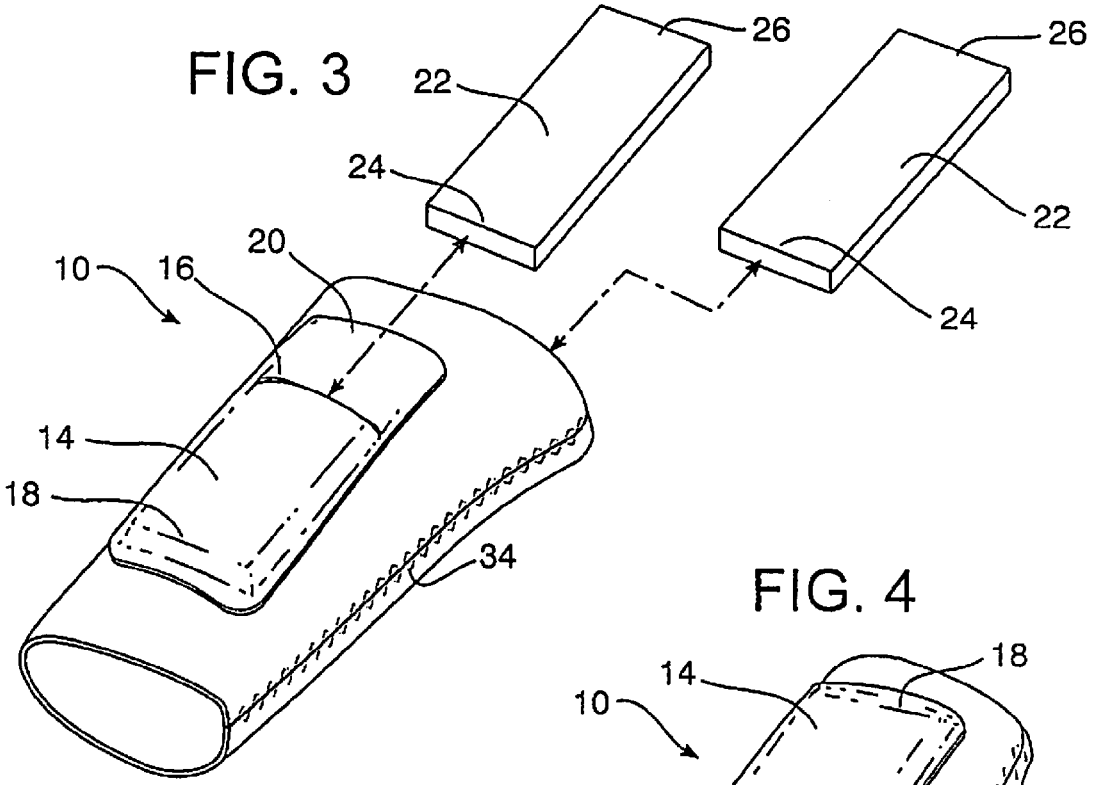
FIG. 3 is an exploded perspective view of the present invention.

FIG. 3 shows an exploded perspective view of the hand speed trainer 10. The weight 22 is sized to fit within the elongated pockets 14. The weights 22 are inserted into the pockets 14 by sliding the first end 24 of the weight 22 through the slot 16 into the first end 18 of the pocket 14. The weight 22 is then secured in the pocket 14 by sliding the second end 20 of the pocket 14 over the second end 26 of the weight 22. There is a second weight 22 shown in FIG. 3 which would be inserted in the same manner into a second pocket 14 mounted on the back side of the hand speed trainer 10 not shown in FIG. 3.

Figure 4:
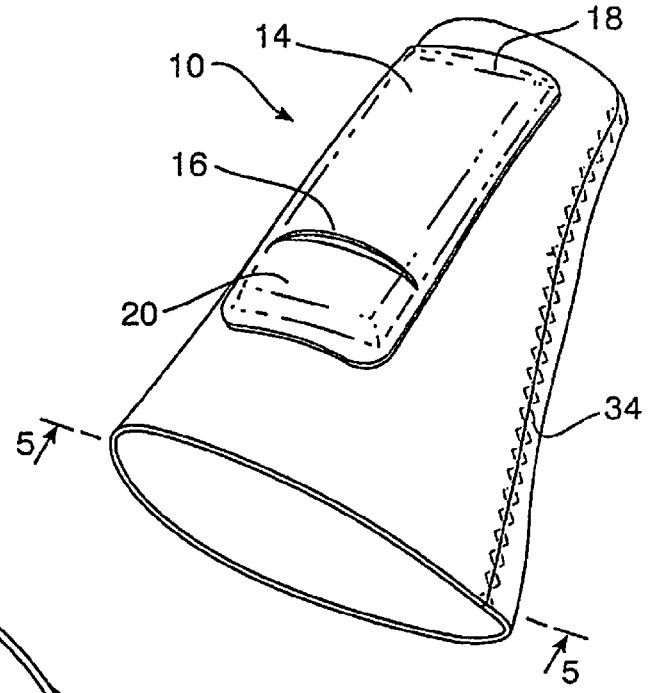
FIG. 4 is a perspective view of the present invention.

FIG. 4 is a perspective view of the opposite side of the hand speed trainer 10 than the one shown in FIGS. 1, 2, and 3. The pocket 14 mounted on the back side of the hand speed trainer 10 is the same as the pocket 14 mounted on the front of the hand speed trainer 10.

Figure 5:
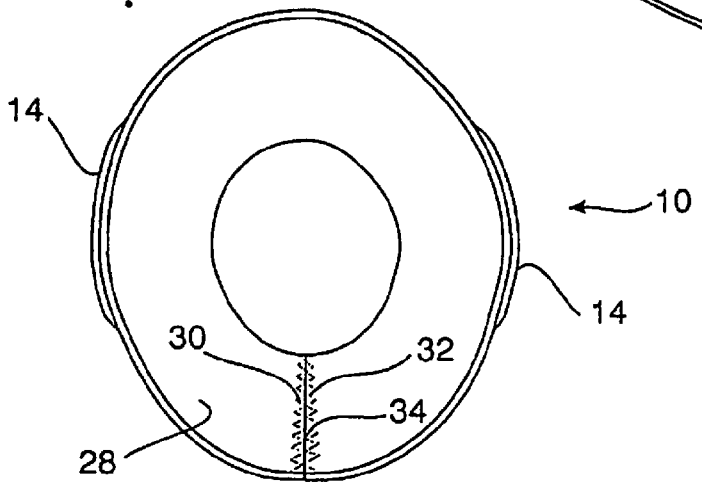
FIG. 5 is an end view of the present invention.

FIG. 5 shows an end view of the hand speed trainer 10 from the angle indicated in FIG. 4. In its preferred embodiment the hand speed trainer 10 is constructed from a single piece of material 28. The pockets 14 are sewn on the outside of the hand speed trainer 10. The first and second edge 30 and 32 of the material 28 are butted together and sewn forming a seam 34.

Figure 6:
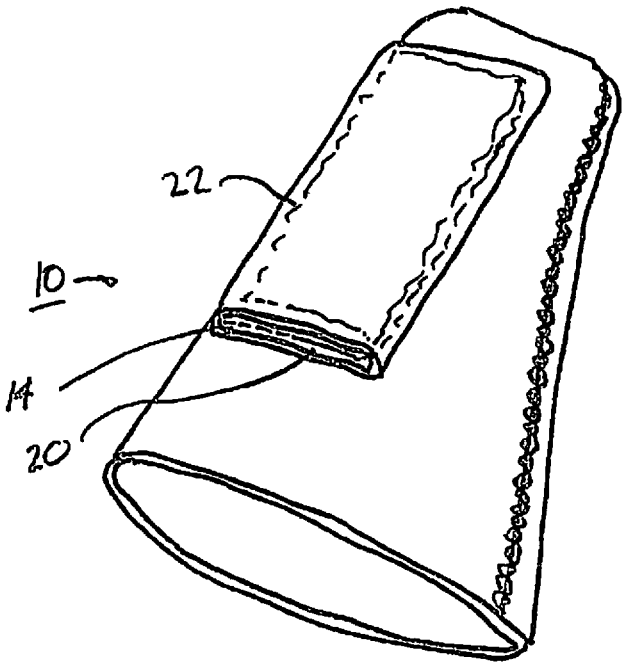
FIG. 6 is a perspective view illustrating an alternate embodiment of the invention.

FIG. 6 is a perspective view illustrating an alternate embodiment of the invention.

In the preferred embodiment the hand speed trainer 10 is constructed out of a nylon laminated CR neoprene rubber. However in alternative embodiments it could be constructed out of any material which is flexible elastic and provides a snug gripping fit. Likewise methods other than sewing could be used to construct the hand speed trainer 10. Such methods might include fusing, adhesives and other methods known in the art.

In the preferred embodiment as shown in FIGS. 1 through 5 the hand speed trainer 10 has a pair of pockets 14 located on either side of the hand speed trainer 10. This allows the weights 22 to run parallel with the radius and ulna of the forearm. This arrangement provides a comfortable and unrestricting fit. In alternative embodiments of the present invention the number and location of the pockets could be increased or decreased while still falling within the inventive concept of this application.

Looking at FIG. 6, the hand speed trainer 10 can be constructed where the pocket 14 does not have a slot 16. In this embodiment the pocket 14 would be sewn along its periphery to the hand speed trainer 1—however the second end 20 of the pocket 14 would be left unsewn so that the weight 22 could slide into the pocket 14 through the unsewn second end 20. The weight 22 would then be retained in the pocket 14 by the fit between the pocket 14 and the weight 22 as well as the centrifugal forces created by the swinging motion of the user's arm.

In the preferred embodiment of the present invention the weight 22 is made of lead. This provides a dense and malleable weight. However other dense materials could be used such as various metals and alloys.

It will be apparent to those skilled in the art that various modifications and variations can be made in the construction, configuration, and/or operation of the present invention without departing from the scope or spirit of the invention. For example, in the embodiments mentioned above, variations in the materials used to make each element of the invention may vary without departing from the scope of the invention. Thus, it is intended that the present invention cover the modifications and variations of the invention provided they come within the scope of the appended claims and their equivalents.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A hand speed trainer to be worn on the forearm of a user during exercise, the hand speed trainer comprising:

a resiliently stretchable sleeve having a longitudinal axis, cross-sections of said sleeve taken transverse to said axis being tapered, and said sleeve being of material of sufficient elasticity, to be snugly contoured to an entire outer perimeter of a forearm of the user from proximately above a wrist of the user to proximately below an elbow of the user;

a rectangular segment of material longitudinally aligned on and attached along its perimeter to said sleeve tube to define a pocket therebetween, said segment having one of a widthwise slit and an open end facilitating insertion of a rectangular weight into said pocket, said pocket being sized to snugly grip said weight when said weight is inserted therein; and a second rectangular segment of material longitudinally aligned on and attached along its perimeter to said sleeve tube to define a second pocket therebetween, said second segment having one of a widthwise slit and an open end facilitating insertion of a second rectangular weight into said second pocket, said second pocket being sized to snugly grip said second weight when said second weight is inserted therein.

2. The trainer according to claim 1, said pocket and said second pocket being diametrically opposed on said sleeve tube.

* * * * *